US005362000A

United States Patent [19]

Schwelling

[11] Patent Number: 5,362,000

[45] Date of Patent: Nov. 8, 1994

[54] PRE-COMMINUTING AND METERING APPARATUS FOR PAPER SHREDDERS

[76] Inventor: Hermann Schwelling, Hartmannweg 5, Salem D-88682, Germany

[21] Appl. No.: 143,482

[22] Filed: Oct. 26, 1993

[30] Foreign Application Priority Data

Oct. 27, 1992 [DE] Germany ..... 4236121

[51] Int. Cl.[5] ..... B02C 18/40; B02C 18/06

[52] U.S. Cl. ..... 241/159; 241/224; 241/236

[58] Field of Search ..... 241/33, 34, 159, 224, 241/229, 236, 243, 292.1

[56] References Cited

U.S. PATENT DOCUMENTS 3,845,907 11/1974 Schwarz ..... 241/224 X
4,757,949 7/1988 Horton ..... 241/224 X

FOREIGN PATENT DOCUMENTS 4090 10/1876 Austria ..... 241/236
2059804 4/1981 United Kingdom ..... 241/236

*Primary Examiner*—Douglas D. Watts
*Attorney, Agent, or Firm*—Friedrich Kueffner

[57] ABSTRACT

A pre-comminuting and metering apparatus, particularly for large plants for shredding paper and similar waste materials. The apparatus includes a pair of cutting rollers arranged at the bottom of a hopper. The cutting rollers are driven in opposite directions and are provided with toothed knife disks. Each knife disk has an inclined circumferential surface defining outermost circumferential edges, wherein the knife disks of the cutting rollers are arranged in pairs and the outermost circumferential edges of each pair of knife disks contact each other. The pairs of knife disks are arranged spaced apart from each other in axial direction of the cutting rollers. The teeth of the knife disks are formed by undercut portions. The undercut portions of the knife disks of each cutting roller are arranged helically offset relative to each other.

8 Claims, 3 Drawing Sheets

PRE-COMMINUTING AND METERING APPARATUS FOR PAPER SHREDDERS

BACKGROUND OF THE INVENTION

1. Field of the Invention

The present invention relates to a pre-comminuting and metering apparatus, particularly for large plants for shredding paper and similar waste materials. The apparatus includes a hopper and arranged at the bottom of the hopper a pair of cutting rollers which are rotatably driven in opposite directions of rotation and are provided with toothed knife disks.

2. Description of the Related Art

A pre-comminuting and metering apparatus of the above-described type is known from DE-OS 39 25 581. However, this known apparatus has the major disadvantage that the cutting mechanism which consists of disks resting against each other poorly grasps thick file bundles or folders. In addition, the paper is pressed together into material strands during comminution, wherein these strands must be disentangled before being further conveyed to a fine comminuting unit by means of a separate subsequently arranged whirling unit of complicated construction.

SUMMARY OF THE INVENTION

Therefore, it is the primary object of the present invention to improve the pre-comminuting cutting mechanism in a pre-comminuting and metering apparatus of the above-described type in such a way that the previous disadvantages are eliminated.

In addition, the amount of energy required for operating the apparatus is to be reduced.

In accordance with the present invention, each knife disk mounted on the cutting rollers has an inclined circumferential surface defining all outermost circumferential edge. The knife disks of the two cutting rollers are arranged in pairs, such that the outermost circumferential edges of each pair of disks are in contact with each other. The pairs of disks are arranged spaced apart from each other by a predetermined distance in axial direction of the cutting rollers.

In accordance with a particularly advantageous further development, the teeth of the knife disks are formed by helically undercutting the circumferential surface resulting in sharp points, wherein the undercut portions of the knife disks on each cutting roller are arranged helically offset relative to each other.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DETAILED DESCRIPTION OF THE PREFERRED EMBODIMENTS

Figure 1:
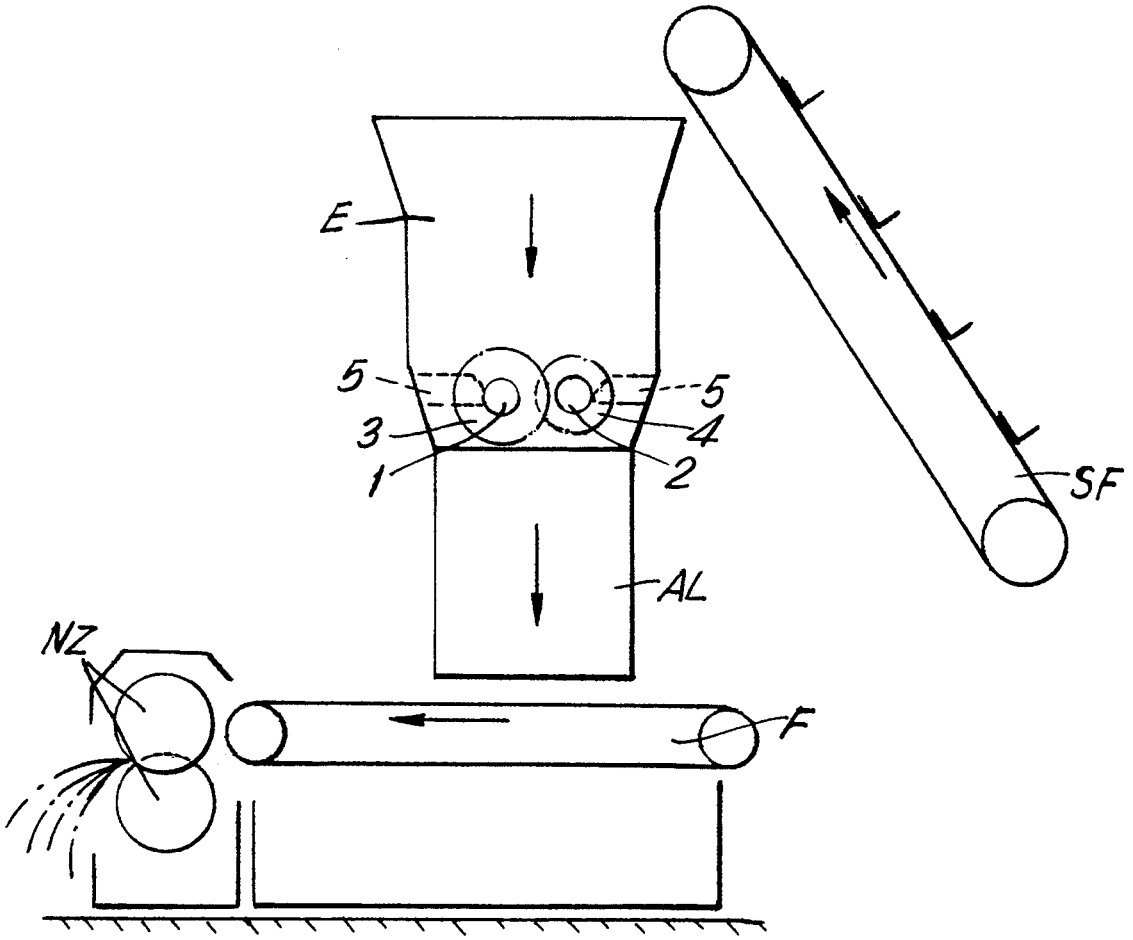
FIG. 1 is a schematic side view of the pre-comminuting and metering apparatus according to the present invention.
Figure 2:
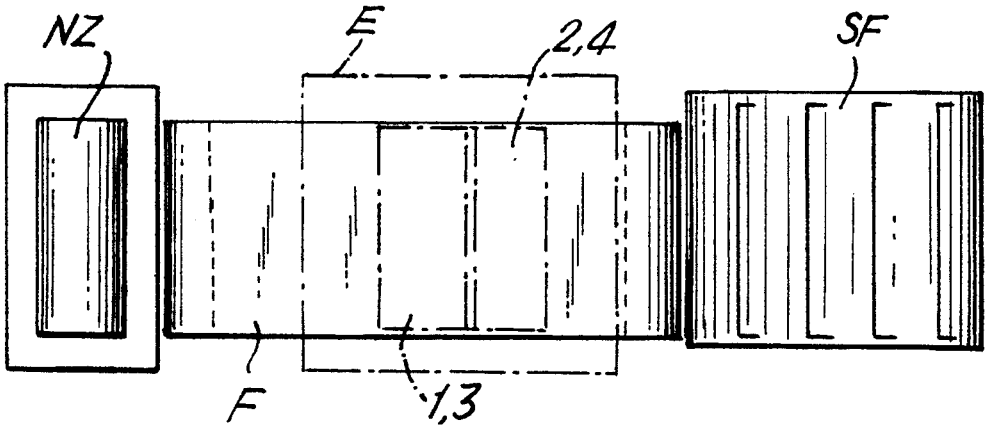
FIG. 2 is a top view of the apparatus of FIG. 1.
Figure 3:
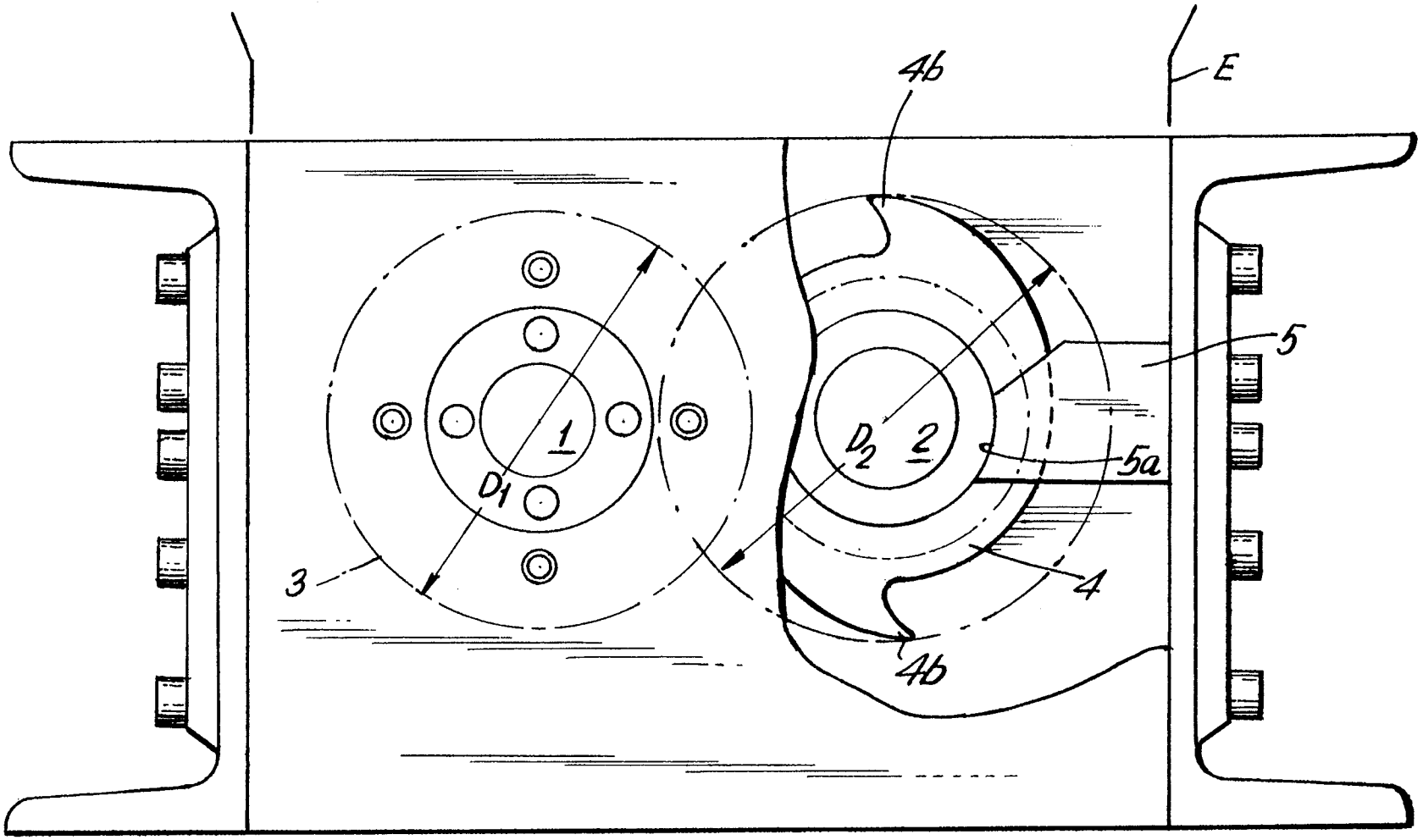
FIG. 3 is a side view, on a larger scale, showing the cutting mechanism of the apparatus according to the present invention.
Figure 4:
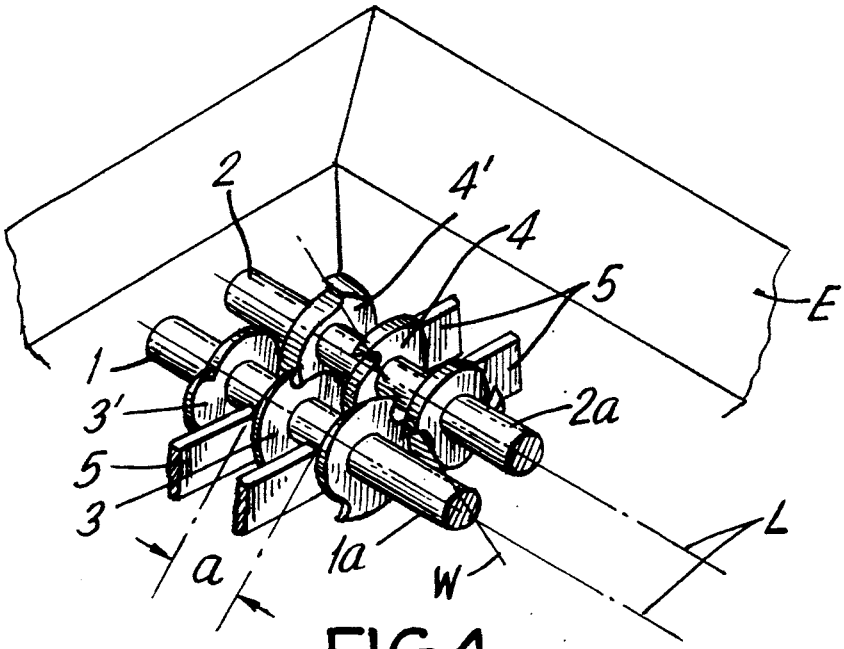
FIG. 4 is a partial perspective view, on a smaller scale than FIG. 3, showing the hopper and the cutting mechanism of the apparatus according to the present invention.
Figure 5:
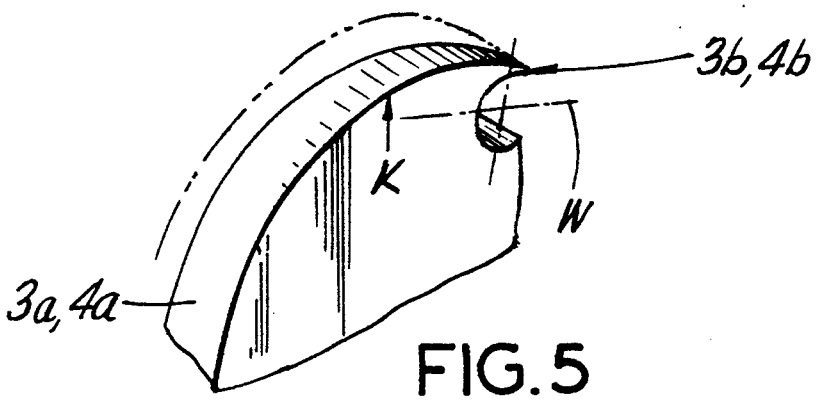
FIGS. 5, 5*a* and 5*b* are a perspective view, a sectional view and a side view, respectively, again on a larger scale, of the cutting disk according to the present invention.
Figure 5A:
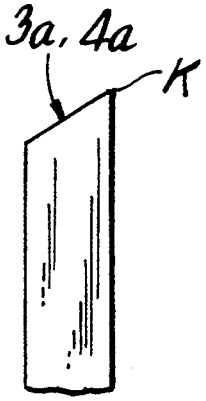
Figure 5B:
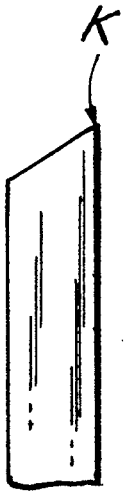

The pre-comminuting and metering apparatus according to the present invention shown schematically in FIGS. 1 and 2 of the drawing includes a hopper E and a pre-comminuting unit mounted at the bottom of the hopper E. The pre-comminuting unit is composed of cutting rollers 1, 2 on which are mounted a plurality of knife disks 3 and 4, respectively.

An essentially vertically directed discharge chute AL is arranged underneath the pre-comminuting unit. An essentially horizontally extending conveyor belt F is arranged underneath the discharge chute AL. The conveyor belt F leads to an after comminuting unit NZ. The waste material is supplied by means of the inclined conveyor unit SF.

In this regard, it is important that the material supply is carried out automatically with load-dependent control. Particularly important is a reversible operation of the after comminuting unit NZ and of the conveyor belt F when the cutting mechanism in the after comminuting unit is overloaded. By providing the conveyor belt F in front of the after comminuting unit NZ, an additional equalization effect of metering is effected.

However, the most important technical teaching of the novel cutting mechanism according to the present invention is illustrated in FIGS. 4, 5, 5*a* and 5*b*. Thus, the knife disks 3, 4 have inclined circumferential surfaces 3*a* and 4*a*, wherein the outermost circumferential edges K of the inclined circumferential surfaces 3*a* and 4*a* are in contact with each other in pairs and each of these pairs of disks 3, 4 are arranged on the drive shafts or cutting rollers 1, 2 at a significant distance a from the next following disks 3', 4' in axial direction L of the cutting rollers 1, 2.

This configuration, particularly together with the fact that the teeth 3*b* and 4*b* are formed by helically undercutting W the cutting disk bodies 3, 3', 4, 4' to form sharp points and that the undercut portions are arranged on each cutting roller 1 and 2 helically offset relative to each other, provides for each pair of disks an always excellent shearing effect with positive cutting angle and, thus, an increase of the tearing and flowing effect which decreases the amount of energy required for driving the cutting mechanism.

The comminuting effect of the new cutting mechanism is further reinforced and improved by alternating pulling-in and engaging conditions in the pre-comminuting cutting unit which result from the fact that the knife disks on the cutting rollers 1 and 2 have different diameters $D_1$ and $D_2$ and from simultaneously rotating the cutting rollers with different rates of rotation, and further from the fact that the undercut portions in the knife disks on one cutting roller have a different height than the undercut portions of the knife disks on the other cutting roller.

The apparatus according to the present invention is completed by the provision of stripping grate bars 5 which extend from both sides of the hopper E into the intermediate spaces between the pairs of knife disks to the circumferential surfaces 1*a* and 2*a* of the cutting rollers. It is advantageous if at least the free ends 5*a* of the bars 5 are inclined or extend obliquely relative to the circumferential surfaces 1*a* and 2*a* of the cutting rollers and, as a result, convey the waste material always toward the comminuting units. In addition, independently of the material fed into the apparatus by the inclined conveyor SF, it is always possible additionally to supply waste paper material or the like to the after comminuting unit NZ by means of the conveyor belt F.

The invention is not limited by the embodiments described above which are presented as examples only but can be modified in various ways within the scope of protection defined by the appended patent claims.

I claim:

1. A pre-comminuting and metering apparatus for shredding paper and similar waste materials, the apparatus comprising a hopper having a bottom, at least one pair of cutting rollers arranged at the bottom of the hopper, means for driving the cutting rollers in opposite directions of rotation, a plurality of knife disks being mounted on the cutting rollers, each knife disk having at least one tooth, each knife disk having an inclined circumferential surface, each circumferential surface defining an outermost circumferential edge, the knife disks of the two cutting rollers being arranged in pairs, wherein the outermost circumferential edges of each pair of disks are in contact with each other, the pairs of disks being arranged spaced apart from each other in axial direction of the cutting rollers, wherein the undercut portions of the knife disks of one cutting roller have a height which is different from the height of the undercut portions of the knife disks on the other of the cutting rollers.

2. The apparatus according to claim 1, wherein each knife disk has a helically undercut portion forming a sharp point-like tooth, and wherein the undercut portions of the knife disks on each cutting roller are arranged helically offset relative to each other.

3. The apparatus according to claim 1, wherein the knife disks on one of the cutting rollers have a diameter which is different from the diameter of the knife disks on the other of the cutting rollers, and wherein the means for driving the cutting rollers include means for driving the cutting rollers at different rates of rotation.

4. The apparatus according to claim 1, wherein the hopper has two sides and intermediate spaces are defined between the pairs of knife disks, further comprising stripping grate bars extending from both sides of the hopper into the intermediate spaces to the cutting rollers.

5. The apparatus according to claim 4, wherein the bars have free ends, wherein at least the free ends of the bars are inclined toward the cutting rollers.

6. The apparatus according to claim 1, further comprising an essentially vertically directed discharge chute arranged underneath the cutting rollers, and an essentially horizontally extending conveyor belt arranged underneath the discharge chute, and an after comminuting unit at an end of the conveyor belt.

7. The apparatus according to claim 6, comprising an automatic, load-dependent control means of the conveyor belt.

8. The apparatus according to claim 7, wherein the control means comprises means for reversible operation of the conveyor belt when the after comminuting unit is overloaded.

* * * * *